United States Patent [19]

Anderson

[11] Patent Number: 4,950,859

[45] **Date of Patent: * Aug. 21, 1990**

[54] BAG FOR CONTAINING EDIBLES DURING MICROWAVE COOKING

[76] Inventor: Alan R. Anderson, 707 Pheasant Run, West Chester, Pa. 19382

[ * ] Notice: The portion of the term of this patent subsequent to Mar. 7, 2006 has been disclaimed.

[21] Appl. No.: 329,026

[22] Filed: Mar. 27, 1989

[51] Int. Cl.[5] ..... H05B 6/80; B65D 81/34

[52] U.S. Cl. ..... 219/10.55 E; 219/10.55 F; 426/243; 426/111; 426/113; 426/234; 99/DIG. 14; 229/DIG. 3

[58] Field of Search ..... 219/10.55 E, 10.55 F, 219/10.55 M; 426/107–115, 234, 241, 243, 242; 206/632; 383/123; 99/DIG. 14, 323.4, 323.5; 229/DIG. 3, 903, 906, 905

[56] References Cited

U.S. PATENT DOCUMENTS

| | | | |
|---|---|---|---|
| 2,865,768 | 12/1958 | Barnes et al. | 426/111 |
| 3,973,045 | 8/1976 | Brandberg et al. | 426/110 |
| 4,038,425 | 7/1977 | Brandberg et al. | 426/107 |
| 4,219,573 | 8/1980 | Borek | 426/107 |
| 4,292,332 | 9/1981 | McHam | 426/111 |
| 4,361,235 | 11/1982 | Gautier | 426/110 |
| 4,450,180 | 5/1984 | Watkins | 426/107 |
| 4,461,031 | 7/1984 | Blamer | 383/123 |
| 4,503,559 | 3/1985 | Warnke | 383/40 |
| 4,553,010 | 11/1985 | Bohrer et al. | 219/10.55 E |
| 4,563,561 | 1/1986 | Vaeth et al. | 219/10.55 E |
| 4,571,337 | 2/1986 | Cage et al. | 426/107 |
| 4,584,202 | 4/1986 | Roccaforte | 426/111 |
| 4,640,838 | 2/1987 | Isakson et al. | 426/107 |
| 4,810,844 | 3/1989 | Anderson | 219/10.55 E |

*Primary Examiner*—Philip H. Leung

*Attorney, Agent, or Firm*—Woodcock, Washburn, Kurtz, Mackiewicz & Norris

[57] ABSTRACT

This invention relates to bags suitable for containing edible components during microwave cooking. The bags comprise two opposing side panels and an inwardly pleated bottom panel between the opposing side panels. The side panels are joined to one another along their side edges and to the bottom panel along its outside edge. Sections of the side panels may also be seamed or bonded to sections of the bottom panel so that the inside surface area of the bottom panel is substantially less than the outside surface area of the bottom panel. The bags optionally contain microwave susceptor materials and self-closing features.

25 Claims, 2 Drawing Sheets

FIG. 3
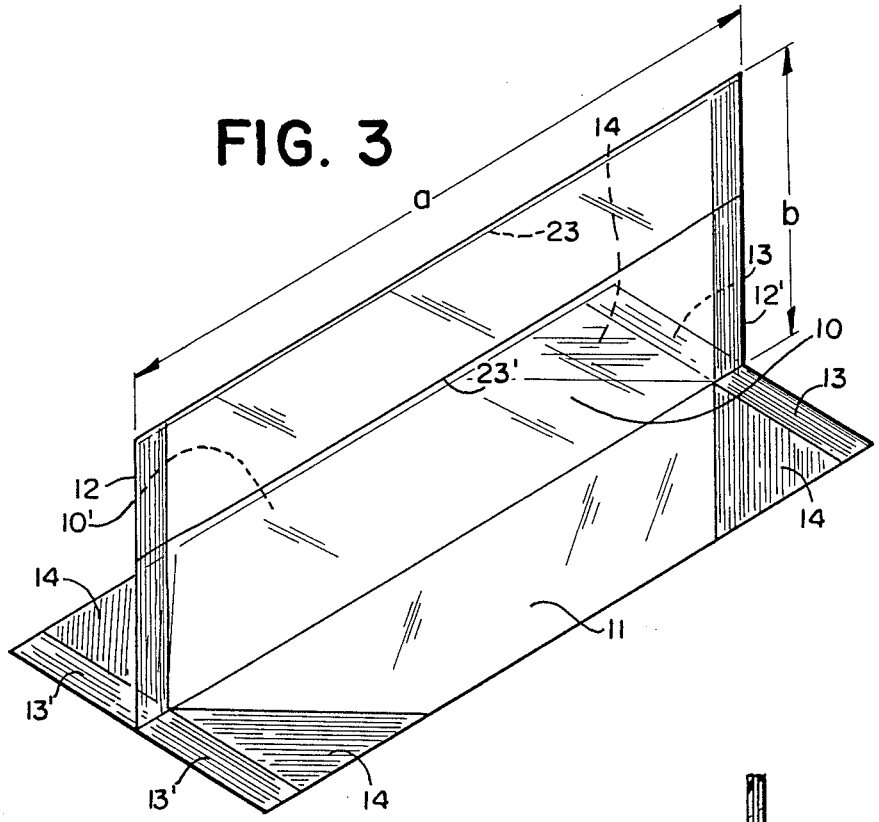
FIG. 4
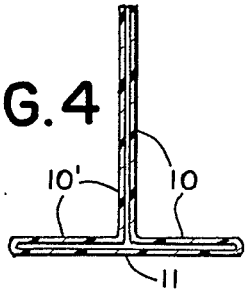
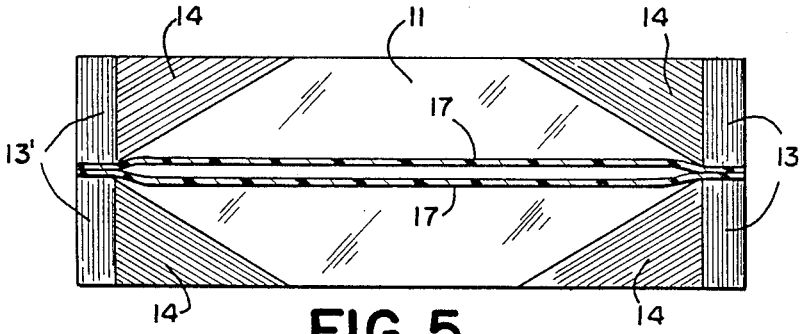
FIG. 5

BAG FOR CONTAINING EDIBLES DURING MICROWAVE COOKING

RELATED APPLICATIONS

This application is related to U.S. Ser. No. 126,366, filed on Nov. 30, 1987, U.S. Pat. No. 4,810,844, for "Microwave Popcorn Package".

BACKGROUND OF THE INVENTION

Recent years have seen an explosion in the popularity of microwave cooking and of foods packaged in containers especially adapted for such cooking. One of the earliest successes in this area was microwavable popcorn packaged in microwavable packages, and numerous patents have been issued on such packages.

U.S. Pat. No. 3,973,045, issued to Brandberg et al., discloses a popcorn packaged in a flexible and expandable package such as a gussetted bag formed from paper. The package is sealed to permit internal pressure to develop to expand the bag so that the corn has sufficient space for the increased volume after popping.

U.S. Pat. No. 4,038,425 to Brandberg et al., discloses as a combined popping and shipping package for popcorn a package composed of a dual compartmented container. The first compartment is relatively small and contains the charge of popcorn; the second compartment is larger and provided with pleats, folds or gussets to enable it to expand to hold the popped kernels.

U.S. Pat. No. 4,219,573 to Borek discloses an expandable popcorn bag, one wall of which has a thermal insulating pad associated therewith to improve the popping performance of the popcorn by preventing heat loss from the package to the oven floor.

U.S. Pat. No. 4,292,332 to McHam discloses an expansible container for popping popcorn comprising a closed bag of flexible sheet material having its upper side provided with a pattern of weakness that serves as an excess vapor pressure release during the popping and which thereafter serves for convenient opening of the container so that it may be used as a serving tray.

U.S. Pat. Nos. 4,450,180 and 4,548,826 to Watkins disclose a popcorn bag formed from a flexible sheet material of collateral tubular configuration, i.e., comprising two parallel longitudinally extending sections communicating together at the center of the package. Substantially all of the popcorn and fat is placed within one tubular section and the other is maintained free of popcorn. During the popping, the empty tubular section is free to expand as it fills with popcorn.

U.S. Pat No. 4,461,031 to Blamer discloses a tubular bag for containing and microwave cooking popcorn. The bag has a closed bottom end, the bottom end having a strength against rupture that exceeds the rupture strength of a future closure at the mouth or upper end of the bag.

U.S. Pat. No. 4,503,559 to Warnke discloses a bag designed to facilitate the separation of popcorn from unpopped kernels and providing a convenient bag for holding the popped corn while a person eats it. The bag has an outer bag of fine mesh and an inner bag of coarser mesh through which unpopped corn can pass, thereby separating it from the popped corn.

U.S. Pat. No. 4,553,010 and U.S. Pat. No. 4,678,882 to Bohrer et al. disclose a microwave popcorn container formed from a single blank, e.g. of paperboard, having a bottom panel coated with a microwave interactive material adding heat to the popcorn to be cooked. The container is configured so that the popcorn kernels placed into it are spaced, on average, no more than the average diameter of one kernel away from the microwave interactive panel.

U.S. Pat. No. 4,571,337 to Cage et al. disclose a bag for cooking popcorn in a microwave oven. The bag has a bottom panel, a top panel, a back panel and inwardly folded gusseted side panels such that the bag can be flattened along the top edge opposite the bottom panel. The top edge seal opens before popping is completed to release steam and prevent the popped corn from becoming too chewy.

U.S. Pat. No. 4,584,202 to Roccaforte discloses a package allowing the popping of popcorn in site within a pouch contained in a carton. The carton has a tear-away portion in its top panel which is removed when the package is put into the microwave oven. The pouch is folded in the carton so that the edges of the folded pouch are disposed beneath the opening formed by removal of the tear-away portion. The top panel of the carton includes marginal constraining portions bounding the opening which constrain the pouch once the popcorn has commenced popping.

The inventor's prior application U.S. Ser. No. 126,366, filed on Nov. 30, 1987, U:S. Pat. No. 4,810,844, claims a combination of a bag and a mixture of edible popcorn ingredients in which the bag comprises two opposing side panels and an inwardly pleated bottom panel between said opposing side panels, the outside edges of said side panels being joined to one another and to the outside edges of said inwardly pleated bottom panel. In the bags described in U.S. Ser. No. 126,366, U.S. Pat. No. 4,810,844 portions of the opposing side panels were further joined to portions of the bottom panel so that the inside surface area of the said bottom panel was substantially less than the outside surface area of the bottom panel. This particular configuration was advantageous because it enabled the popcorn ingredients to be readily massed together for more efficient popping.

Until recently, there had been only limited success in cooking meat products by microwave, in part because of the difficulties in browning or crisping a food product in a microwave oven. In some instances, microwave susceptor materials have beein incorporated into cooking packages and containers for the foods to enhance browning or crisping. New product formulations for foods may also include special spice or bread coatings or sauces which can be combined with meat products to provide an appetizing product when the meat product is cooked by microwave, even in the absence of browning or crisping. The packaged products might include, for example, a suitable microwave cooking package and a sauce or spice mixture to which the consumer adds a meat product. The sauce or spice mixture and the meat product are combined in the microwave cooking package, and the entire package is placed in the microwave oven.

It has now been found that the bags disclosed in U.S. Ser. No. 126,366, U.S. Pat. No. 4,810,844 may be modified and conveniently utilized for microwave cooking of not only popcorn but also other foods to be cooked by microwave.

SUMMARY OF THE INVENTION

This invention relates to a combination of a bag and an edible component to be cooked in a microwave oven, said combination comprising a bag comprising first and second opposing side panels, each having a top edge and opposing side edges, and an inwardly pleated bottom panel between said first and second opposing side panels, said bottom panel having opposing side edges, the side edges of said first and second side panels being joined to one another, the side edges of said first and second side panels further being joined to said inwardly pleated bottom panel only at the side edges of said panel; said side and bottom panels comprising a material substantially transparent to microwave energy and capable of withstanding temperatures reached during the microwave cooking of said edible component. Edible components are generally placed inside the bag, on the inside surface of the bottom panel, thereby enabling the bag to stand upright.

This invention further relates to a bag suitable for holding an edible component during microwave cooking comprising first and second opposing side panels, each having top and opposing side edges, and an inwardly pleated bottom panel between said first and second side panels, the side edges of said first and second side panels being joined to one another and to the outside edges of said inwardly pleated bottom panel, portions of said first and second side panels further being joined to portions of said bottom panel so that the inside surface area of said bottom panel is substantially less than the outside surface area of said bottom panel, said panels comprising a material substantially transparent to microwave energy and capable of withstanding temperatures reached during the microwave cooking of said edible component.

The bags of this invention are preferably greater in width than in height, i.e., the distance between the opposing outside edges of the side panels is greater than the length of the seam joining the side panels to one another. Thus, the upper opening of the bag, through which the edible components are placed prior to cooking and through which they are thereafter removed, is quite large, making the packaging and serving processes that much more convenient. The configuration of the bags of this invention thus contrasts favorably to the traditional flat-bottomed, side gussetted bag (of the lunch bag type) in which many microwavable food products are sold at this time. In those bags, the bottom panel is generally kept as small as possible to conserve packaging material (since the bag construction requires overlap of extensions of each of the bag panels). Since the top opening is also only as big as the small bottom panel, filling the bag and serving from it are somewhat difficult.

DESCRIPTION OF THE DRAWINGS

FIGS. 2 and 3 are perspective views of a bag of this invention.

FIG. 4 is a cross-sectional view of the bag of either FIGS. 2 or 3.

FIG. 5 is a perspective view of the bottom of the bag of FIG. 3.

DETAILED DESCRIPTION OF THE INVENTION

This invention will be described in greater detail below in reference to FIGS. 1 to 5.

Figure 1:
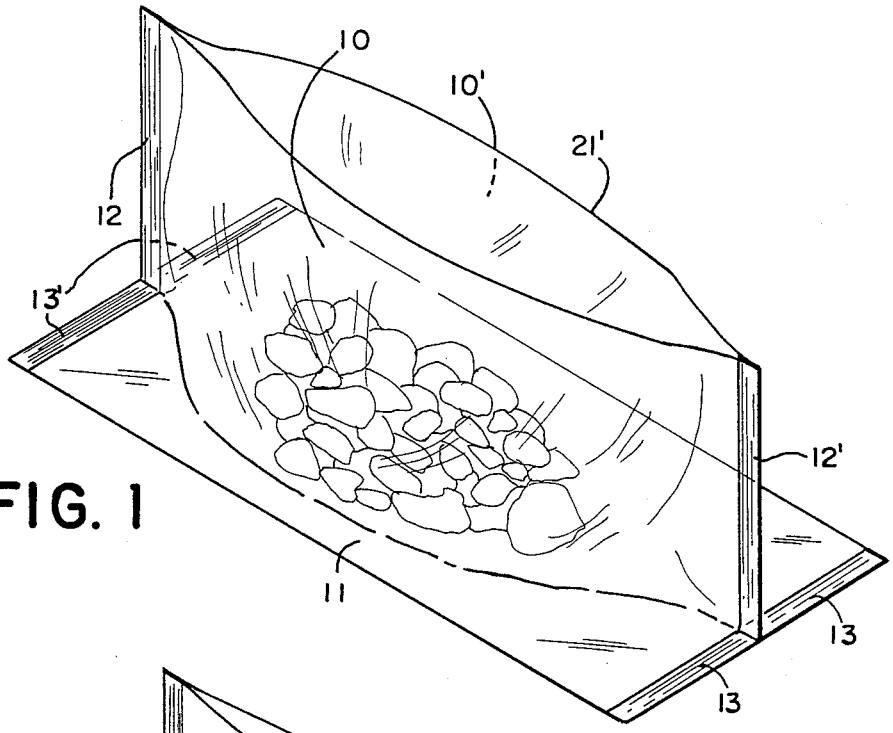
FIG. 1 is a perspective view of a combination bag and edible component according to this invention.

A bag constructed in accordance with this invention is illustrated in FIG. 1. In this figure, as well as in FIGS. 2 and 3, the bag is illustrated as being formed from a visible light-transparent material, however, non-transparent materials such as paper may also be utilized. An advantage of the transparent materials is that they allow the consumer to watch the edible component inside as it cooks, cutting down on the chances of under- or overcooking. The material from which the bag is formed must be flexible, substantially transparent to microwave energy and must be able to withstand the high temperatures reached during the microwave cooking of popcorn and oils, e.g., up to about 370° F. The material from which the bag is made is also preferably impervious to the cooking oil or fats packaged with the popcorn. Examples of suitable materials are films of polyesters, such as polyethylene terephthalate, polyolefins such as polypropylene, polycarbonates and nylon. An especially preferred film is polyethylene terephthalate film coated on one side with a copolyester that allows for heat sealing. Suitable materials also include paper which may be treated to improve its liquid imperviousness by, for example, lamination to the above-mentioned films, coating with polypropylene or treatment with materials such as fluoropolymers. From a packaging standpoint, it is advantageous if the material from which the bag is made provides sufficient water and vapor permeability to allow for a long shelf life of the packaged ingredients. If the bag is not made from such a barrier material as, for example, a paper bag, it may be overwrapped with a barrier material such as a polyethylene terephthalate film to provide barrier protection. The overwrap would be removed by the consumer prior to placing the microwave package in the oven.

Referring to all of the figures, they show a popcorn bag according to this invention having first and second opposing side panels 10 and 10' connected to a bottom panel 11 having an inward pleat or gusset 17. Side panels have top edges 21 and 21' and side edges which are joined to one another at side seams 12 and 12'. Side panels 10 and 10' are joined to bottom panel 11 at seams 13 and 13'.

In the embodiment shown in FIG. 3, sections of side panels 10 are seamed or bonded to sections of bottom panel 11 in areas 14 to provide for a bottom panel 11 having an inside surface area substantially smaller than its outside surface area. As embodied in the specific package illustrated in the figure, the areas 14 are triangular, leaving bottom panel 11 with an inside surface roughly in the shape of a hexagon. To provide a bag in which the inside surface area of the bottom panel is substantially smaller than the outside surface area of said panel, it will generally be desired to join or bond sections of side panels 10 to bottom panel 11 so as to "cut off" the corners of bottom panel 11, as illustrated in the figure. Other means for bonding side panels 10 to bottom panel 11 may also be feasible, however, the only limiting factor being that bottom panel 11 retain a surface area sized and configured so as to permit edible components to be placed on it. Advantages accruing from this configuration include the ability to mass edible components together for more efficient cooking, and the elimination of sharp corners in which edible components can be stuck. As previously mentioned, the bags of this invention are preferably greater in width than in height (the distance a is greater than distance b, as shown in FIG. 3) to allow for more convenient serving and packaging.

In the embodiment illustrated in FIG. 3, the inside surface area of bottom panel 11 is substantially smaller than the outside surface area of bottom panel 11 to provide a bag which has an upper opening wide enough to permit easy filling and serving and a bag in the bottom of which the edible components can be readily massed together for more efficient cooking. It is not possible to define the exact extent to which the inside surface area of bottom panel 11 will differ from the outside surface area of said panel, but it is estimated that the inside surface area will generally be about 80% to 93%, preferably about 85%, of the outside surface area of the bottom panel. The bag could be configured so that the inside surface area of the bottom panel is even less than 80% of the outside surface area; however, there are no advantages to such configurations and they tend to waste film or other package material. The differences in surface area will vary according to the shape of the bag and the amount of edible component therein.

Side panels 10 and 10' are preferably joined to each other and to bottom panel 11 by means of heat sealing, however suitable FDA-approved adhesives may also be used. If the seams are to be made by heat sealing, the interior surface of the film or paper from which the bag is made, or at least the area of the seams, is coated with a coating sensitive to a combination of heat and pressure, commonly referred to as a heat seal coating.

Figure 2:
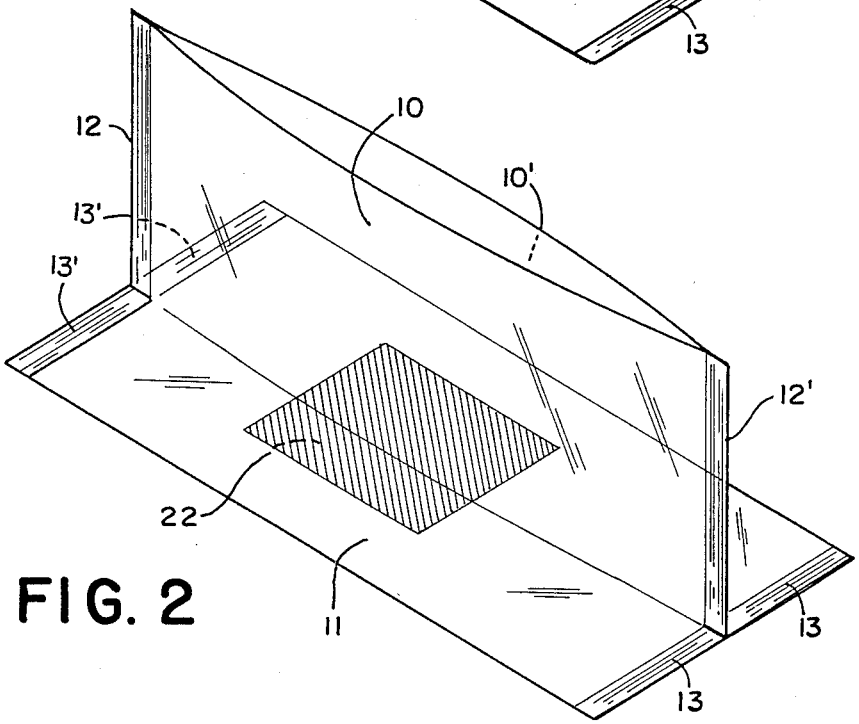

In a preferred embodiment of this invention, as illustrated in FIG. 2, a microwave interactive material 22 capable of converting a portion of the incident microwave energy to heat is placed inside the bag. The presence of the microwave interactive material can increase cooking efficiency. Examples of suitable microwave interactive materials are known in the art, e.g., U.S. Pat. No. 4,190,757 to Turpin et al., U.S. Pat. No. 3,783,220 to Tanizaki, U.S. Pat. No. 4,290,924 to Brastad et al. and U.S. Pat. No. 4,283,427 to Winters et al. For use in this invention, the preferred microwave interactive material is lightly metallized polyethylene terephthalate film which can be laminated, e.g., to Kraft paper, paper board or polyester film, and placed, metallized surface up, adjacent to the surface of bottom panel 11. In another embodiment, the bag may be formed from a laminate of two layers of paper, with the susceptor material contained between said layers of paper and placed in bottom panel 11.

The edible components which may be packaged in the bags of this invention may be any food capable of being cooked by microwave. Examples include various meat products and snacks such as popcorn. Depending on the nature of the edible component, it may be sold in combination with the bag, such as popcorn which is packaged and sold in the bag, or may be placed in the bag by the consumer.

Side panels 10 and 10' are preferably joined to each other and to bottom panel 11 by means of heat sealing, however suitable FDA-approved adhesives may also be used. If the seams are to be made by heat sealing, the interior surface of the film or paper from which the bag is made, or at least the area of the seams, is coated with a coating sensitive to a combination of heat and pressure, commonly referred to as a heat seal coating.

In the case of edibles such as popcorn which are sold in combination with the bag, the bag may be sealed at the upper edges of side panels 10 and 10' after addition of the edible components during a single make/fill process. The seam used to join side panels 10 and 10' at their upper edges is preferably the most easily separated film-to-film seam, making it easy for the consumer to open the bag after cooking by pulling side panels 10 and 10' apart at their upper edges. Although the top seam may be made to remain closed throughout the entire cooking process, it may be advantageous that it open at least partially during the last part of the cooking process to allow steam to escape. The seam can therefore be specially configured to allow such vapor pressure release by applying the heat seal or a water-sensitive adhesive (e.g., a polyvinyl alcohol adhesive) in a pattern which provides weak spots.

If the edible component to be cooked is one which is to be added by the consumer, e.g., a perishable product such as meat or a vegetable, it may be desirable to provide a means for closing the bag prior to cooking to avoid splattering of liquids in the food during cooking. One self-closing means for the bags of this invention is illustrated in FIG. 3. In this embodiment, the top edge 23' of first side panel 10' is formed to extend beyond the top edge 23 of second side panel 10, and first side panel 10' is folded over second side panel 10' to form self-closing means for the bag. The top portion of second side panel 10' may be tucked under the flap formed by the folded-over, extended portion of side panel 10' to close the bag.

Another advantage of the package configuration of this invention is the ease with which the bags may be made and filled. A continuous web of material, such as the aforementioned polyethylene terephthalate film coated with a heat and pressure sensitive material, is folded longitudinally to create an inwardly directed pleat or gusset. At this point, a cross-sectional view of the web of material would show a W-shaped configuration. Heat and pressure are applied to the web at appropriate intervals to create heat seals between opposite panels of the web. The heat seals are configured so as to create a continuous length of bags, having side seams 12 and 12', bottom seams 13 and 13' and optional sealed areas 14 as described above, and joined to one another at adjacent side seams. The optional microwave interactive material is next placed adjacent to the bottom panel of each bag, followed by edible popcorn ingredients. Heat and pressure are again applied to seal the top edges of the line of bags, creating seam 16, and the bags are separated.

What is claimed is:

1. A combination of a bag and an edible component to be cooked in a microwave oven, said combination comprising a bag comprising first and second opposing side panels, each having a top edge and opposing side edges, and an inwardly pleated bottom panel between said first and second opposing side panels, said bottom panel having opposing side edges, the side edges of said first panel being joined to the side edges of said second side panel, the side edges of said first and second side panels further being joined to said inwardly pleated bottom panel only at the side edges of said bottom panel; said side and bottom panels comprising a material substantially transparent to microwave energy and capable of withstanding temperatures reached during the microwave cooking of said edible component; said edible component being placed on the inside surface of said bottom panel.

2. The combination of claim 1 in which the top edge of said first side panel extends beyond the top edge of said second side panel and said first side panel is folded over said second side panel to form self-closing means for said bag.

3. The combination of claim 1 in which said material is a film of a material selected from polyesters, polyolefins, polycarbonates and nylon.

4. The combination of claim 3 in which said material is a polyethylene terephthalate film.

5. The combination of claim 1 in which said panels comprise paper.

6. The combination of claim 1 in which said side panels are joined together in seals, a portion of which open during cooking of said edible component to allow for venting of steam.

7. The combination of claim 1 in which a microwave interactive material is placed on or adjacent to said bottom panel.

8. The combination of claim 7 in which said microwave interactive material is a lightly metallized film laminated to paper.

9. The combination of claim 8 where said metal is aluminum.

10. The combination of claim 7 in which the area of said microwave interactive material is large enough so that substantially all edible component may be situated thereon.

11. The combination of claim 1 in which said side panels are joined to one another and to said bottom panel by heat seals.

12. The combination of claim 1 in which the length of the top edge of said first and second side panels is greater than that of the side edge of said panels.

13. A bag suitable for holding an edible component during microwave cooking comprising first and second opposing side panels, each having top and opposing side edges, and an inwardly pleated bottom panel between said first and second side panels, the side edges of said first panel being joined to the side edges of said second side panel, the side edges of said first and second side panels further being joined to the outside edges of said inwardly pleated bottom panel, portions of said first and second side panels further being joined to portions of said bottom panel so that the inside surface area of said bottom panel is substantially less than the outside surface area of said bottom panel, said panels comprising a material substantially transparent to microwave energy and capable of withstanding temperatures reached during the microwave cooking of said edible component.

14. The bag of claim 13 in which the top edge of said first side panel extends beyond the top edge of said second side panel and said first side panel is folded over said second side panel to form self-closing means for said bag.

15. The bag of claim 13 in which said material is a film of a material selected from polyesters, polyolefins, polycarbonates and nylon.

16. The bag of claim 15 in which said material is a polyethylene terephthalate film.

17. The bag of claim 13 in which said panels comprise paper.

18. The bag of claim 13 in which said side panels are joined together in seals, a portion of which open during cooking of said edible component to allow for venting of steam.

19. The bag of claim 13 in which a microwave interactive material is placed on or adjacent to said bottom panel.

20. The bag of claim 19 in which said microwave interactive material is a lightly metallized film laminated to paper.

21. The bag of claim 20 where said metal is aluminum.

22. The bag of claim 13 in which said side panels are joined to one another and to said bottom panel by heat seals.

23. The bag of claim 13 in which the length of the top edge of said first and second side panels is greater than that of the side edge of said panels.

24. The bag of claim 13 in which the inside surface are of said bottom panel is about 80% to 93% of the outside surface of said panel.

25. The bag of claim 13 in combination with a microwavable food other than popcorn.

* * * * *